US005208578A

United States Patent [19]

Tury et al.

[11] Patent Number: 5,208,578

[45] Date of Patent: May 4, 1993

[54] LIGHT POWERED CHIME

[76] Inventors: Jon M. Tury, 11641 U.S. 27, DeWitt, Mich. 48820; Edward L. Tury, 9732 Rosemary La., Brighton, Mich. 48116

[21] Appl. No.: 685,554

[22] Filed: Apr. 15, 1991

[51] Int. Cl.[5] ..... G08B 3/00; G10K 1/00

[52] U.S. Cl. ..... 340/393; 340/392; 340/394; 84/600; 84/404; 116/141

[58] Field of Search ..... 340/392, 393, 394, 395, 340/396, 397, 398, 384 R, 384 E; 116/141, 169, 172; 136/291; 84/402, 404, 600, 601; 446/421

[56] References Cited

U.S. PATENT DOCUMENTS

| | | | |
|---|---|---|---|
| 864,461 | 8/1907 | Gibbs | 84/402 |
| 1,835,901 | 12/1931 | Rodet et al. | 340/392 |
| 2,988,708 | 6/1961 | Schmidt | 340/392 |
| 3,777,701 | 12/1973 | Nofziger | 116/169 |
| 4,702,140 | 10/1987 | Goldfarb | 84/639 |
| 4,854,214 | 8/1989 | Lowe | 84/404 |
| 4,873,790 | 10/1989 | Laterza | 136/291 |
| 5,072,208 | 12/1991 | Christensen | 340/392 |

*Primary Examiner*—Donnie L. Crosland
*Attorney, Agent, or Firm*—Price, Heneveld, Cooper, DeWitt & Litton

[57] ABSTRACT

A light powered chime for indoor use specifically designed to be random, approximating a windchime. In one embodiment a solar cell provides current to a timing circuit and to a storage capacitor. The timing circuit intermittently fires a silicon controlled rectifier causing current to flow from the capacitor through a motor. A striker is connected to the motor shaft by way of a string and clip. Rotation of the motor causes the striker to contact one or more suspended chimes. Randomness is achieved by virtue of sunlight variability and by the mechanical and electrical design.

12 Claims, 4 Drawing Sheets

LIGHT POWERED CHIME

BACKGROUND OF THE INVENTION

1. Field of the Invention

The invention is in the field of solar or light powered musical devices and specifically relates to a solar or light powered chime.

2. Prior Art

In U.S. Pat. No. 4,841,587 a solar powered musical mat with sound system is described. This is for sunbathing and listening to the radio.

In U.S. Pat. No. 4,702,140 Goldfarb describes solar powered musical ornaments and novelties. These are microprocessor controlled devices which have prerecorded sounds programmed into semiconductor memory.

SUMMARY OF THE INVENTION

Windchimes have been around for centuries and have given people pleasure by virtue of their pleasant, random sound. Because they require a breeze to be activated their use is typically limited to outdoor locations and can only be enjoyed on breezy days.

The present invention uses solar or indoor light energy to operate a chime in a random manner. The result is a device that has the qualities of a wind driven chime yet can be used indoors on a windowsill or near a lamp.

The frequency and intensity of the chime sound is a function of the light intensity striking a light to electrical energy converter, such as silicon solar cells.

The randomness is a result of the electrical and mechanical design of the chime as well as the ambient light randomness (e.g. partly cloudy day).

A chime that never stopped or one that sounded at even intervals would be boring and unpleasant. This invention overcomes these problems by driving the chime striker intermittently by way of an electromechanical device, such as a motor. Electrical energy from the solar cells is stored on a capacitor and is released to the motor via a silicon controlled rectifier (SCR). The SCR is fired from a timing circuit whose main element is a programmable unijunction transistor (PUT).

Both the charge on the motor driving capacitor and the timing circuit frequency are a function of the current flowing out of the solar cells which in turn is a function of the ambient light.

The number of rotations or fractional rotations of the motor depend on the charge stored in the motor capacitor. This is essentially independent of the timing circuit in so much as that the timing circuit has its own time constant independent of the motor capacitor. In a controlled laboratory environment the circuit will have a predictable behavior but in the intended use the operation will vary.

Further randomness is obtained by the striker design. Depending on where the striker starts its motion and its position relative to the chimes (either moving or at rest) the sound produced is found to be very random yet pleasant.

This invention allows indoor enjoyment of random chimes and may also be used as an "alarm clock" for people who wish to arise at dawn.

In the preferred embodiment, a motor drives the cylindrical striker.

In a first alternative embodiment, a solenoid drives the striker.

In a second alternative embodiment, the striker is a lobed, flat disk.

In a third alternative embodiment, the striker is a round, flat disk.

The accompanying drawings show only one physical embodiment of the invention. It is expressly understood that this invention can be housed in virtually limitless exterior configurations.

DETAILED DESCRIPTION OF THE PREFERRED EMBODIMENT

For purposes of this description the word solar is used to describe the source of power for this invention. It is understood that indoor light sources will also cause the device to operate in the manner described herein.

Figure 1:
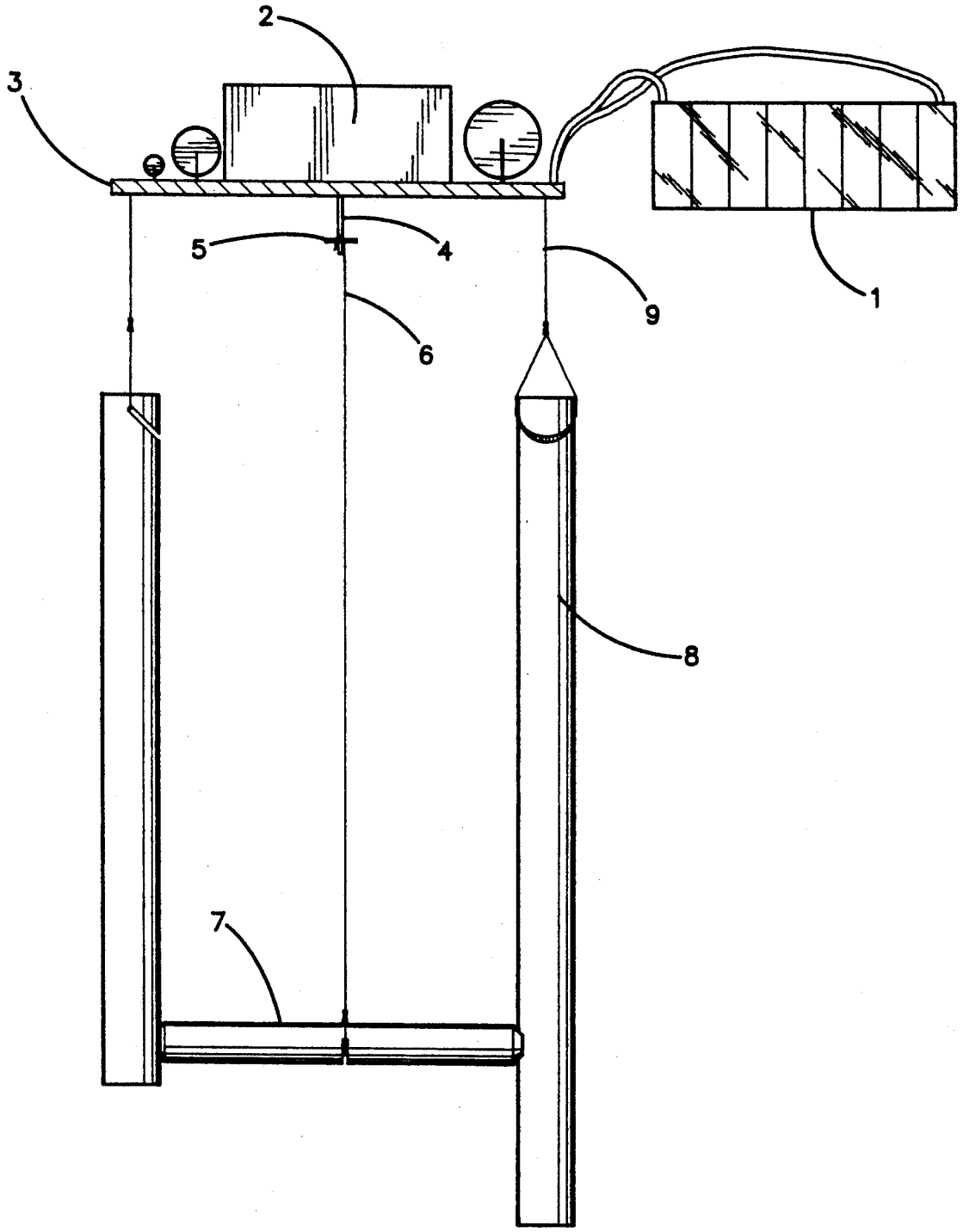
FIG. 1 shows the preferred embodiment of the invention. Only 2 chimes are shown for clarity.
Figure 2:
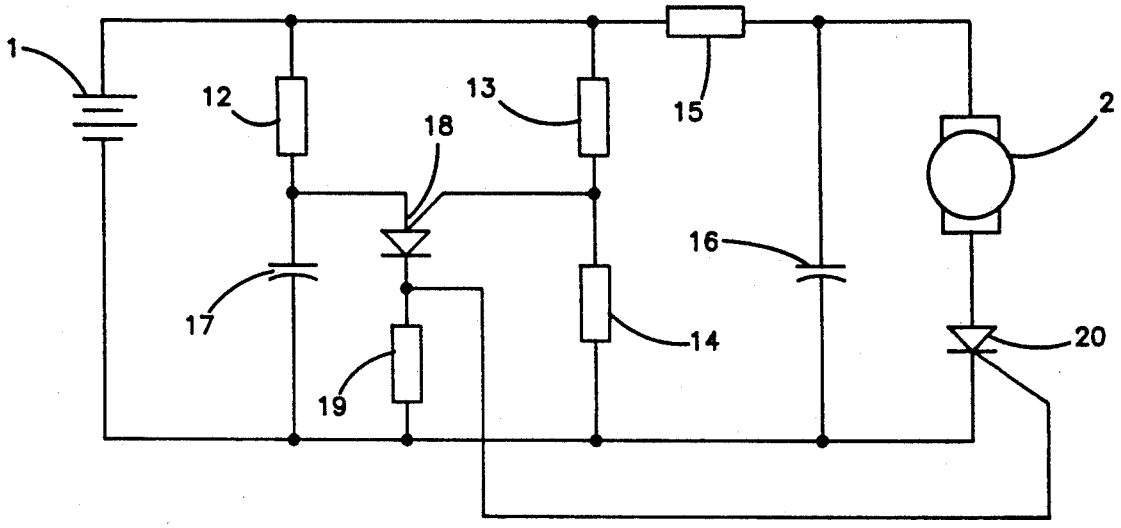
FIG. 2 shows the schematic diagram of the electronics.

Refer to FIGS. 1 and 2. When solar energy strikes solar cells 1 electrical current flows through resistor 12, and charges timing capacitor 17. Resistor 12 and capacitor 17 are part of a relaxation oscillator whose other components are programmable unijunction transistor (PUT) 18, and resistors 13 and 14.

The output frequency of the oscillator will vary if the amount of solar cell current varies.

The output of PUT 18 is a voltage pulse that appears across resistor 19, and it is applied to the gate of a silicon controlled rectifier (SCR) 20.

When the oscillator produces an output pulse, SCR 20 turns on and allows current to flow out of capacitor 16, through motor 2. Resistor 15 is the charging path for capacitor 16.

After capacitor 16 discharges, the current through SCR 20 drops below its holding current, and this causes SCR 20 to turn off.

With varying solar energy the resultant circuit action produces an intermittent rotation of motor shaft 4. In bright light conditions, the shaft 4 may rotate several times; in lower light conditions, it may only make ½ of a complete revolution.

The motor shaft 4 is connected to a striker 7 by means of a clip 5 string 6 against the shaft. String 6 suspends striker 7 so that striker 7 is perpendicular to suspended chimes 8.

Figure 3:
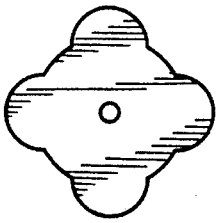
FIGS. 3 and 4 show alternate striker configurations.
Figure 4:
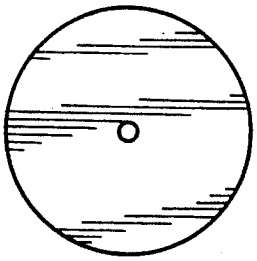

When motor shaft 4 spins, it stores energy in string 6. As string 6 unwinds, striker 7 rotates, and hits one or more of the chimes 8. Possible other striker shapes are shown in FIGS. 3 and 4.

Figure 6:
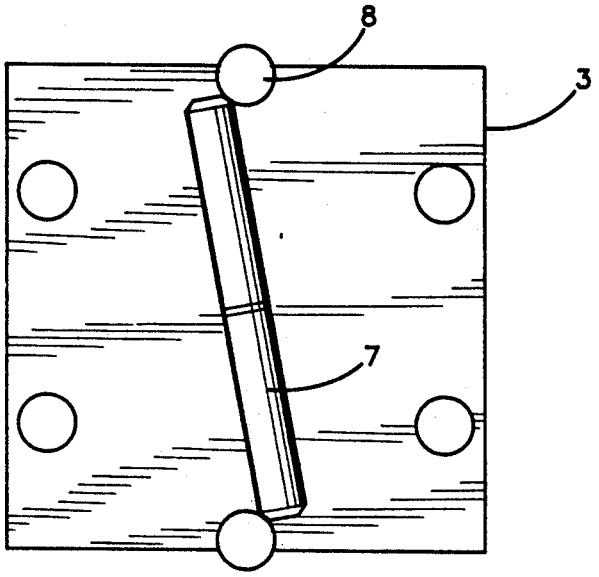
FIG. 6 best shows the chime and striker orientation of the preferred embodiment as viewed from below.

Chimes 8 are suspended from a circuit board 3 by means of a suitable string 9. In the preferred embodiment 6 chimes are used, and their mounting holes are equally spaced on an imaginary circle which is concentric with the motor shaft. This is shown in FIG. 6.

In situations where the solar energy is high, striker 7 hits chimes 8 with sufficient force and frequency to keep them in motion, thereby contributing to the randomness.

In lower light conditions, between chiming intervals, striker 7 may stop moving. For this case, the position of striker 7, relative to the chimes 8, is unpredictable. This random initial condition contributes to the overall random nature of the chiming.

In the preferred embodiment, striker 7 is cylindrical steel, chamfered on both ends, and suspended by a thin string attached to a point midway between the chamfered ends. The length of the striker is such that, when striker 7 comes to rest against one of the chimes 8, the contact point between the chimes and striker is on the chamfer.

In the preferred embodiment chimes 8 are solid tubular aluminum, and are hard enough to resonate when struck.

Figure 5:
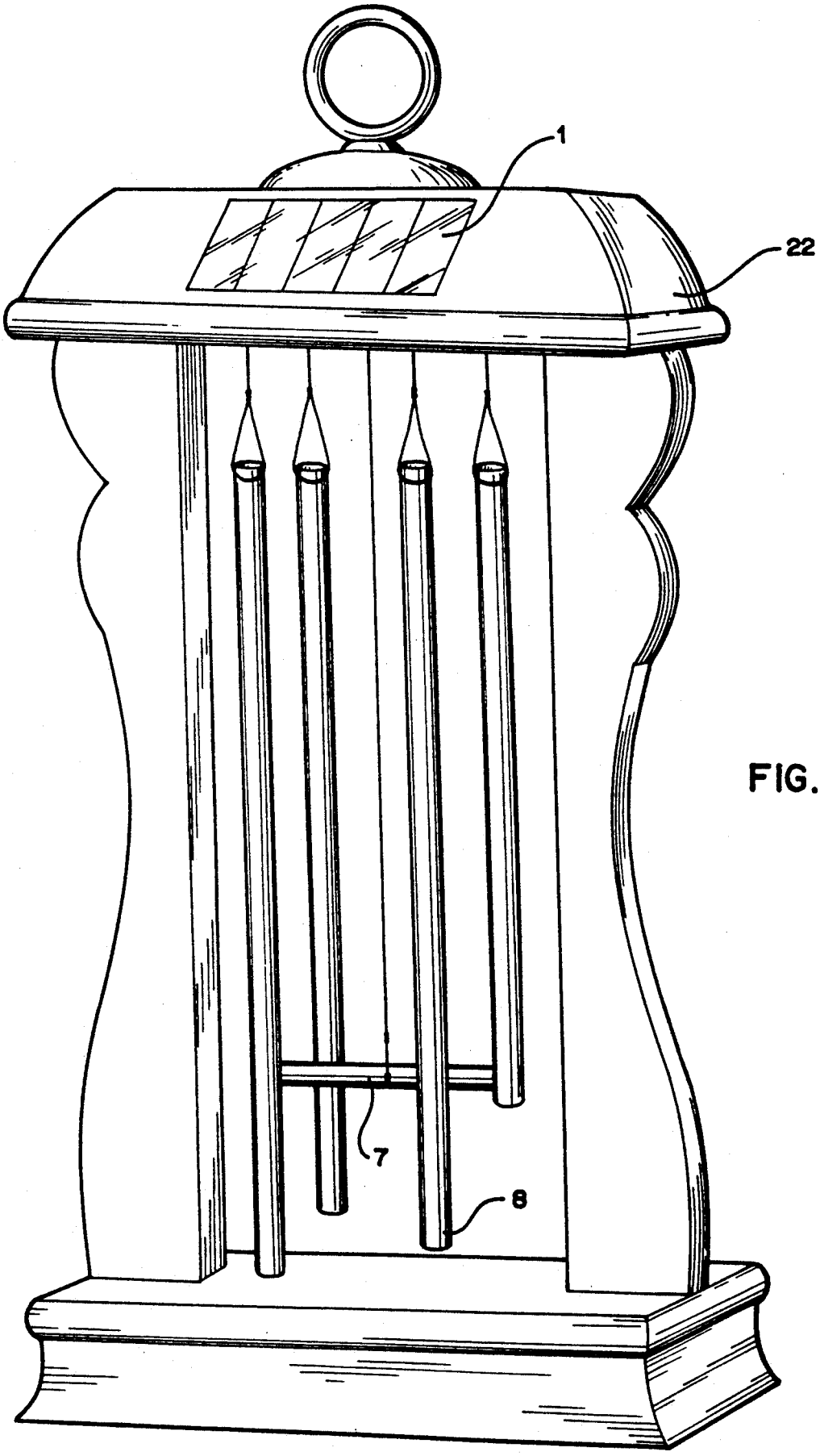
FIG. 5 shows a possible decorative housing for the invention.

With the exception of solar cells 1, which mount to an external surface of housing 22, all components mount to circuit board 3. See FIG. 5.

Figure 7:
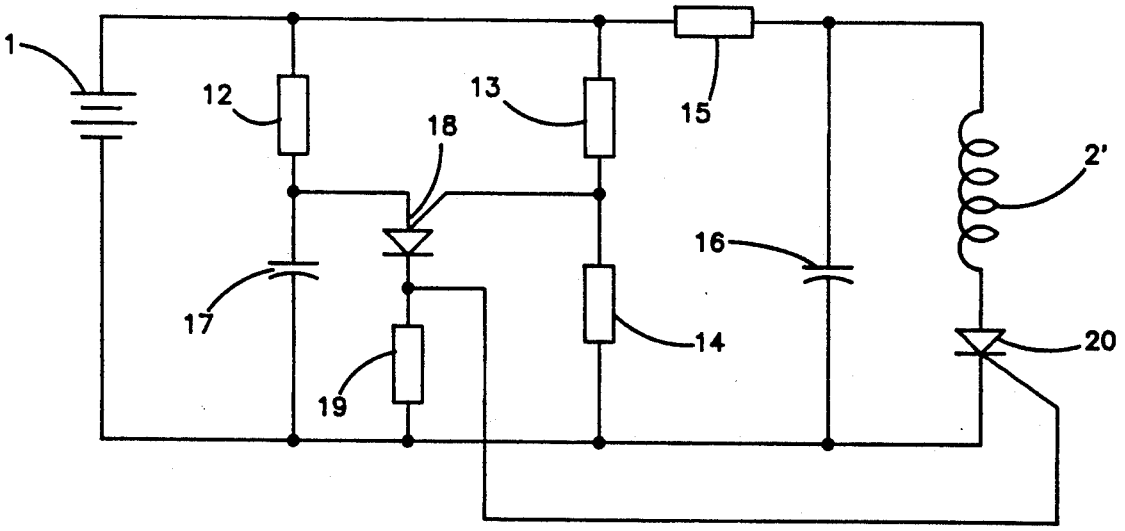
FIG. 7 is the same view as FIG. 2 of an alternative embodiment of the electronics.

FIG. 7 illustrates an alternative embodiment in which a solenoid 2' is the electromechanical device which converts electrical energy into mechanical motion. By reference to FIGS. 1 and 5, it is seen that striker 7 is suspended by string 6 midway between the chamfered ends of the striker. The result is that the longitudinal axis of the striker is essentially perpendicular to the string.

The foregoing detailed description illustrates one embodiment of the invention and it is to be understood that additional embodiments thereof will be obvious to those skilled in the art. The embodiment described herein together with other embodiments are considered to be within the scope and spirit of the invention.

What is claimed is:

1. A light powered musical chime apparatus which produces an intermittent and random sound comprising:

a housing;

a plurality of resonating elements suspended from said housing;

a motor mounted to said housing;

a striker suspended from an output shaft of said motor such that said striker is capable of contacting said resonating elements in a random and non-sequential manner when said output shaft is rotated;

an electronic circuit adapted to intermittently switch a varying amount of power to said motor at time intervals of varying length, wherein the amount of said power and said length of said intervals being determined by a varying output of a variable power source supplying power to said electronic circuit; and a solar cell mounted to the housing so as to be exposed to ambient light to produce said varying output and electrically connected to supply said varying output to said electronic circuit thereby providing said variable power source.

2. The apparatus of claim 1 wherein said striker has a cylindrical shape with chamfered ends.

3. The apparatus of claim 2 wherein said striker is suspended by a suitable string attached to said striker at a point midway between said chamfered ends such that the longitudinal axis of said striker is essentially perpendicular to said string.

4. A light powered chime apparatus comprising:

converter means for converting light energy into electrical energy;

a timing device responsive to said converter means and adapted for producing a periodic command having a period that varies with the amount of light energy converted to electrical energy by the converter;

an energy storage device adapted to storing said electrical energy from said converter means;

electromechanical means for converting electrical energy into mechanical motion;

switch means for switching said electrical energy from said storage device to said electromechanical device in response to said command of said timing device in order to cause said electromechanical means to produce said mechanical motion;

a striker;

connection means for connecting said striker to said electromechanical device; and one or more chimes mounted such that they may be contacted by said striker when said mechanical motion of said electromechanical means causes said striker to move.

5. The apparatus of claim 4 wherein said electromechanical means is a motor with a protruding output shaft and wherein said connection means connects said striker to said output shaft.

6. The apparatus of claim 5 wherein said striker is a metal cylinder with chamfered ends suspended at its midpoint and said connection means is a string and clip.

7. The apparatus of claim 4 wherein said energy storage device is a capacitor.

8. The apparatus of claim 4 wherein said switch means is a silicon controlled rectifier.

9. The apparatus of claim 4 wherein said timing device is a relaxation oscillator.

10. The apparatus of claim 4 wherein said chimes are solid aluminum rods.

11. The apparatus of claim 4 wherein said electromechanical device is a solenoid.

12. The apparatus of claim 4 wherein said converter means includes at least one silicon solar cell.

* * * * *